US007222635B2

(12) United States Patent
Cantwell

(10) Patent No.: US 7,222,635 B2
(45) Date of Patent: May 29, 2007

(54) TENT HAVING AN OUTER SKIRT AND TUB FLOOR

(75) Inventor: Robert Cantwell, Leslie, MO (US)

(73) Assignee: North Pole, Ltd., Kowloon (HK)

( * ) Notice: Subject to any disclaimer, the term of this patent is extended or adjusted under 35 U.S.C. 154(b) by 0 days.

(21) Appl. No.: 10/423,229

(22) Filed: Apr. 24, 2003

(65) Prior Publication Data

US 2004/0173251 A1 Sep. 9, 2004

(51) Int. Cl.
*E04H 15/54* (2006.01)
*E04H 15/56* (2006.01)
*E04H 15/42* (2006.01)

(52) U.S. Cl. ..... 135/137; 135/156; 135/115; 135/116; 135/117

(58) Field of Classification Search ..... 135/136, 135/137, 156, 93, 115, 116, 913, 117
See application file for complete search history.

(56) References Cited

U.S. PATENT DOCUMENTS 548,425 A * 10/1895 Biddle ..... 135/100
2,543,684 A * 2/1951 Blanchard ..... 135/94
3,342,192 A * 9/1967 Tombari ..... 135/136
3,536,083 A * 10/1970 Reynolds ..... 5/415
4,193,413 A * 3/1980 Watts et al. ..... 135/98
4,195,651 A * 4/1980 Watts et al. ..... 135/135
4,265,261 A * 5/1981 Barker ..... 135/100
4,269,210 A * 5/1981 Marks ..... 135/125
4,285,355 A * 8/1981 Lundblade ..... 135/147
4,305,414 A * 12/1981 Bareis ..... 135/116
4,625,468 A 12/1986 Hampel ..... 52/2
4,709,718 A * 12/1987 Nichols ..... 135/125
4,887,317 A 12/1989 Philips, Sr. et al. ..... 2/243 R
4,960,144 A 10/1990 Wheatley et al. ..... 135/101
5,067,505 A * 11/1991 Cantwell et al. ..... 135/125
5,195,842 A 3/1993 Sakow ..... 405/60
5,218,982 A 6/1993 Kenji ..... 135/90
5,261,436 A * 11/1993 Funk ..... 135/156
5,365,961 A 11/1994 Bamber et al. ..... 135/91
5,579,799 A * 12/1996 Zheng ..... 135/126
5,655,340 A 8/1997 Pelsue ..... 52/71
D397,399 S * 8/1998 Bury et al. ..... D21/834

(Continued)

OTHER PUBLICATIONS http://www.walmart.com/catalog/product.gsp?product_id=2041898&cat=5147&type=21&dept=4125&path=0%3A4125%3A4128%3A5147.*

(Continued)

*Primary Examiner*—Tamara L. Graysay
(74) *Attorney, Agent, or Firm*—Armstrong Teasdale LLP

(57) ABSTRACT

A tent (10) having a fabric enclosure (16) which including a number of walls (18), a floor (22) having a floor perimeter (4) and a framework (14) which supports the fabric enclosure (16) and urges it to expand outwardly. The walls (18) meet the floor (22) and are attached together at a joining seam (25) near the floor perimeter (4). The floor (4) is preferably a tub floor (32) which is joined to the walls (18) at the joining seam (25) which is at a distance vertically removed from the ground plane. One or more skirts (34) are attached to the walls (18) at a distance vertically removed from the ground plane. The skirts (34) are attached external to the floor perimeter (4) and overlap a portion of the walls (18) so that the wall portion and floor perimeter (4) is protected from rainfall.

20 Claims, 5 Drawing Sheets

U.S. PATENT DOCUMENTS

| | | | | |
|---|---|---|---|---|
| D397,400 | S * | 8/1998 | Bury et al. | D21/834 |
| 6,021,796 | A * | 2/2000 | Vavra | 135/147 |
| 6,167,898 | B1 | 1/2001 | Larga et al. | 135/137 |
| 6,216,715 | B1 * | 4/2001 | Howe | 135/95 |
| 6,338,356 | B1 | 1/2002 | Wallenstatter | 135/100 |
| D465,004 | S * | 10/2002 | Funk et al. | D21/834 |
| 6,481,166 | B2 | 11/2002 | Shelton | 52/167.1 |
| D470,559 | S * | 2/2003 | Funk et al. | D21/834 |
| 6,543,465 | B2 * | 4/2003 | Choi | 135/120.1 |
| 6,550,189 | B2 | 4/2003 | Shelton | 52/167.1 |
| D478,645 | S * | 8/2003 | Pearcy | D21/834 |
| 6,672,323 | B2 * | 1/2004 | Gupta et al. | 135/126 |
| 2002/0000241 | A1 * | 1/2002 | Lee | 135/156 |
| 2002/0179133 | A1 * | 12/2002 | Abbinante | 135/124 |
| 2003/0127123 | A1 * | 7/2003 | Choi | 135/115 |

OTHER PUBLICATIONS http://www.walmart.com/catalog/product.gsp?product_id=2168438&cat=5147&type=21&dept=4125&path=0%3A4125%3A4128%3A5147.* http://www.walmart.com/catalog/product.gsp?product_id=2041896&cat=5147&type=21&dept=4125&path=0%3A4125%3A4128%3A5147.* http://www.alaskan.com/amh/Equipment/Tents/Choosing%20a%20Tent%204.htm.*

* cited by examiner

TENT HAVING AN OUTER SKIRT AND TUB FLOOR

TECHNICAL FIELD

The present invention relates generally to portable dwelling structures and more particularly to a waterproof tent.

Background Art

Tents have been used for centuries as temporary structures for camping trips. During these trips, on one hand, a camper usually desires to get away from the complications of city life, but there are generally competing desires for comfort on the other hand. The use of lightweight materials has made the satisfaction of these competing desires more easily accomplished. Tent fabrics, as well as tent poles and frame structures, can now be made to be very strong, while also very lightweight. This use of materials allows more imaginative and varied structures to be designed, which are still light enough to be easily portable, and thus practical for camping trips.

One of the most important aspects of comfort however, involves remaining dry. In an outdoors environment, there is generally no available source of heat other than a campfire. When it rains, even this source of heat may be difficult to maintain. Thus when a camper becomes wet, he is likely to remain so for a while. Body heat is more easily lost through wet garments, and there may be a very real danger of hypothermia in camping situations where clothing and sleeping bags have become wet, and no ready source of heat is available. Thus, a dry environment for camping is of primary importance for enjoying the camping experience, and even in preserving life in some situations.

Waterproof roof panels and rainflies are well-known components of camping tents, and these may do a good job of deflecting rain from the upper portion of the tent's interior living space. However, there remain problems with rain run-off and rain which may be wind-driven onto lower portions of the tent. Although these lower portions are also generally made of water repellant material, there may be problems with seepage through seams where panels are joined, or with floor panels through which water may filter, especially if there are areas of standing water which accumulate around the tent's lower portion.

DISCLOSURE OF INVENTION

Accordingly, it is an object of the present invention to provide a tent which is well protected from water seepage.

Another object of the invention is to provide a tent which has a tub floor in which the joining seam to the walls is vertically elevated from the ground.

And another object of the invention is to provide a tent in which seams are protected by a skirt which shields seams from rain seepage.

A further object of the present invention is to provide a tent which has optional windows which are protected from rainfall by extension sleeves.

An additional object of the present invention is to provide a tent which is very light-weight, yet very water-proof.

Briefly, one preferred embodiment of the present invention is a tent, having a fabric enclosure which including a number of walls, a floor having a floor perimeter, and a framework which supports the fabric enclosure and urges it to expand outwardly. The walls meet the floor and are attached together at a joining seam near the floor perimeter.

The floor is preferably a tub floor which is joined to the walls at the joining seam which is at a distance vertically removed from the ground plane. One or more skirts are attached to the walls at a distance vertically removed from the ground plane. The skirts are attached external to the floor perimeter and overlapping a portion of the walls so that the wall portion and floor perimeter is protected from rainfall.

An advantage of the present invention is that it is well protected from water seepage.

Another advantage of the present invention is that the tent of the present invention has a tub floor in which the joining seam to the walls is vertically elevated from the ground.

And another advantage of the present invention is that tent of the present invention has seams which are protected by a skirt which shields seams from rain seepage.

A further advantage of the present invention is that the tent of the present invention may have optional windows which are protected from rainfall by extension sleeves.

A yet further advantage is that the tent of the present invention is very light-weight, yet very water-proof.

An additional advantage is that the water-proofing design using hidden floor construction may be used in a variety of tent styles and models including dome tents, cabin tents, tents with ceiling vents, and tents with or without windows.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
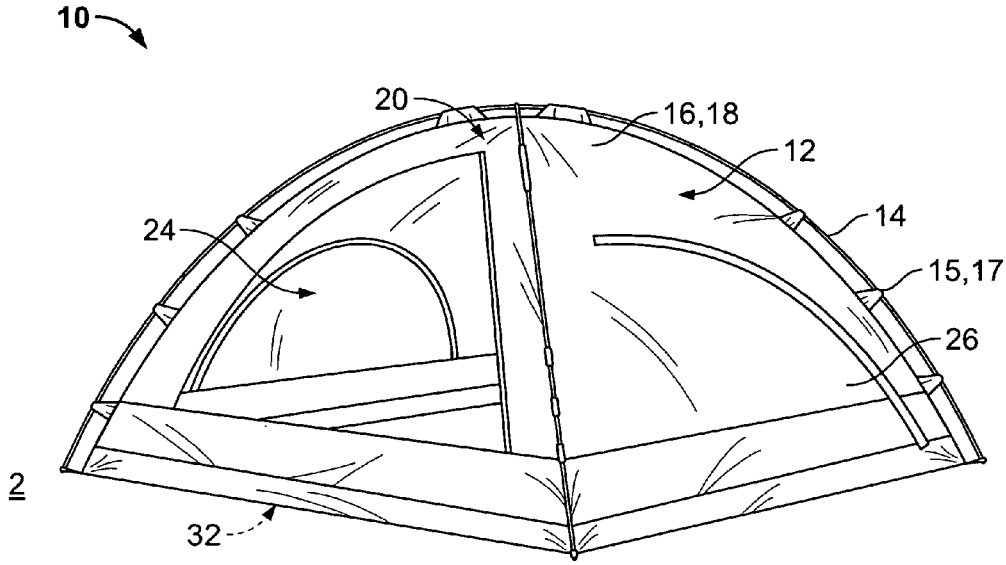
FIG. 1 shows a front perspective view of the waterproof tent of the present invention.

A preferred embodiment of the present invention is a waterproof tent. As illustrated in the various drawings herein, and particularly in the view of FIG. 1, a form of this preferred embodiment of the inventive device is depicted by the general reference character 10.

Figure 4A:
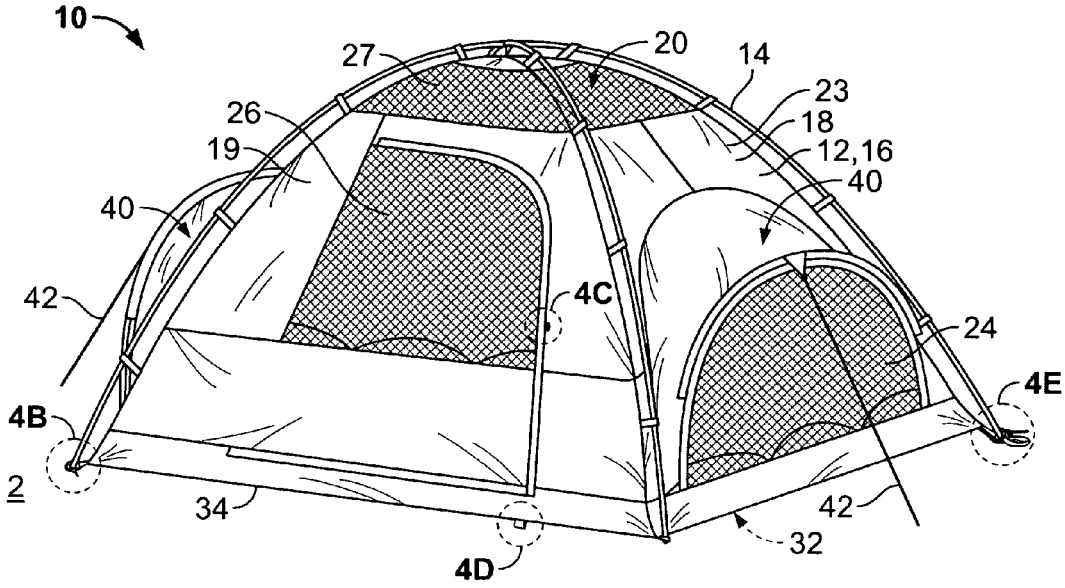
FIG. 4A shows a front perspective view of the waterproof tent with various features shown in detail in FIGS. 4B–4E.
Figure 4B:
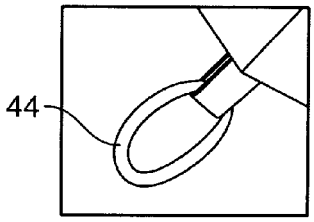
Figures 1, 4C:
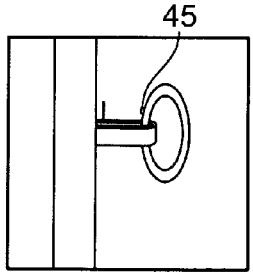
Figures 2, 4C:
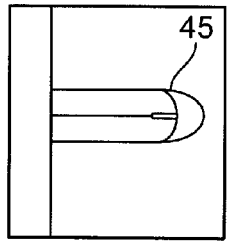
Figure 4D:
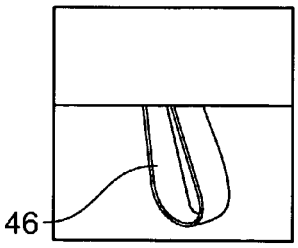
Figure 4E:
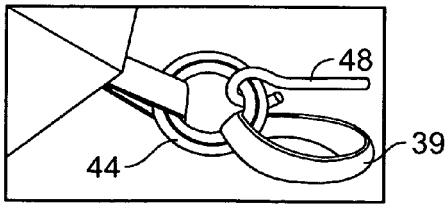
Figure 5:
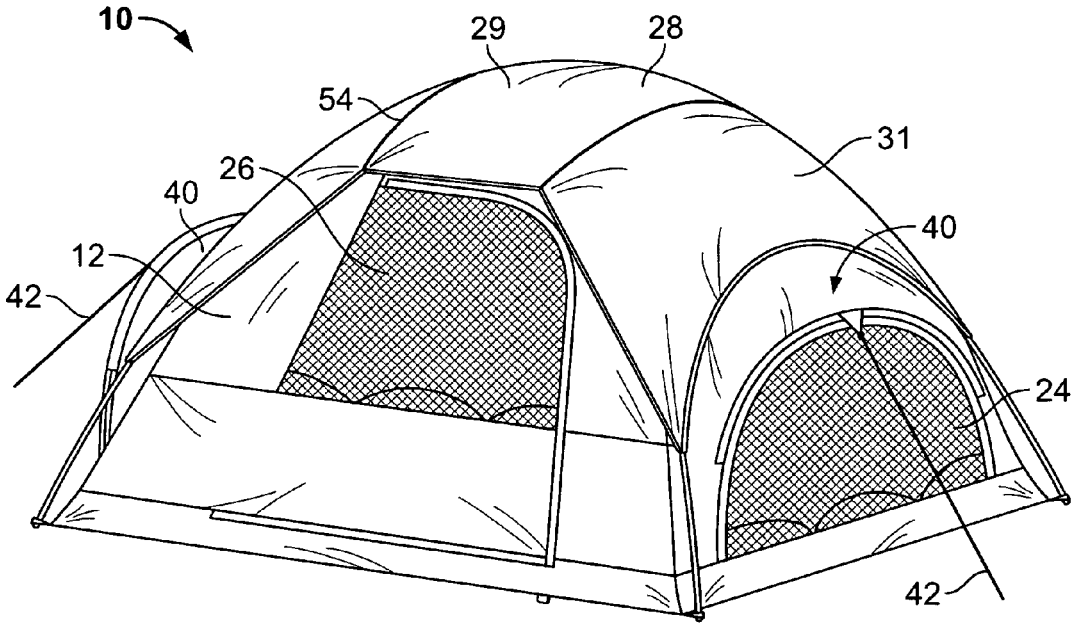
FIG. 5 shows a front perspective view of the waterproof tent with its protective rainfly.

FIGS. 1–8 show various aspects of the tent 10. The tent 10 includes a tent body 12, framework 14, fabric enclosure 16, which make up walls 18, ceiling 20, tub floor 32, windows 24 and a door 26. The fabric enclosure 16 is attached to the framework 14 by loops 15 which may include clips (not shown) that attach to the framework members. The ceiling 20 is preferably mesh screen, as are the windows 24. A rainfly 28 is included, as seen in FIGS. 5–6. The walls generally include a front wall 19, a rear wall 21 and two side walls 23. The walls 18 meet and are attached to the tub floor 32 at a joining seam 25. This joining seam 25 is near the floor's perimeter 4 and is raised vertically above ground level 2, so that water may pool around the tents perimeter to a certain depth without reaching the joining seam 25 and entering the tent 10. The tub floor 32 is preferably made of polyethylene plastic, nylon or polyester, and may be treated with a polyurethane 6 mm–3000 mm coating to increase water-resistance (note "mm" in this context is an industry convention for naming coating thickness and does not mean literally "millimeters"—i.e. 3000 mm coating is not 3 meters thick). The joining seam 25 is preferably vertically elevated from the ground 2 by a distance of 3–10 inches, although this is not a requirement.

Several features are included to make the tent waterproof. Primarily, there is used a hidden floor construction 30 (see FIGS. 2 and 3) in which a tub floor 32 is included inside an outer skirt 34. There are preferably separate loops 36, 35 and stakes 38 used for the tub floor 32 and the skirt 34, as shown in FIG. 3, although it is also possible that the tub floor stake loop 36 has a shock cord 37 which extends out under the corner of the tent and is then held down by the same stake 38 which is used to stake the skirt stake loop 35, as shown in FIG. 2.

The inventor has found that one major site of leakage is the upper seam where the stake loop 36 attaches to the floor or wall, as in the prior art. To protect this area from rainfall, the present invention includes a skirt 34, which is preferably attached to the tent walls 18 at or above above the joining seam 25, thus rain fall is directed away from the floor 32, and particularly the attachment seam of the stake loop 36, and therefore helps to keep the interior dry.

Figure 2:
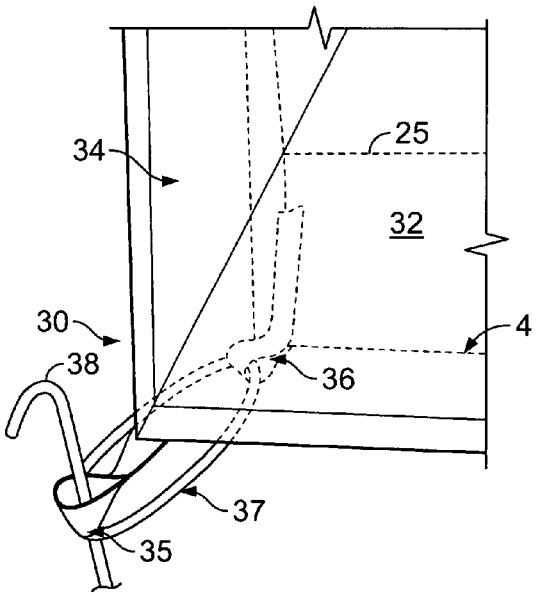
FIG. 2 shows a detail view of the corner of the waterproof tent with its protective skirt.
Figure 3:
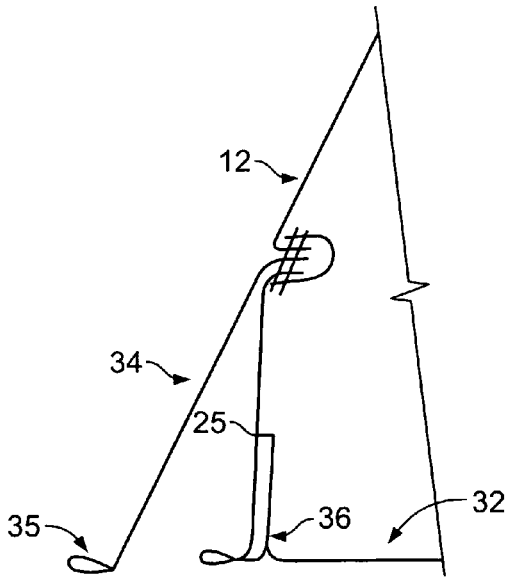
FIG. 3 shows a detail schematic view of the corner of the waterproof tent with its protective skirt.

The skirt 34 may alternately be attached at the same joining seam 25 which attaches the tub floor 32 to the walls 18, as shown in FIG. 3, or the skirt 34 may be attached at a point higher up vertically to protect the entire joining seam, as is shown in FIG. 2.

The hidden floor construction may be used with many different styles and configurations of tents, with or without windows, with or without a vented ceiling, and can be used on cabin style or dome tents. The tent shown in this discussion is a dome-style tent having side windows and a vented ceiling portion, but it is to be understood that the invention is not limited to the style shown.

In this embodiment, the windows 24, preferably of the side walls 23, are optionally equipped with extension sleeves 40 which protrude from the side walls 23 so that the windows 24 slope inward, and may extend at its highest point beyond the perimeter 4 of the floor 22. Guy wires 42 are included, which pull the windows 24 outward in their extension sleeves 40, and keep them taut. The windows 24 thus are sheltered from rain run-off. There are also interior window and door flaps (not shown).

The seams are preferably taped, and there are zipper covers which are preferably 3 inches wide which also prevent moisture from entering.

Figure 6A:
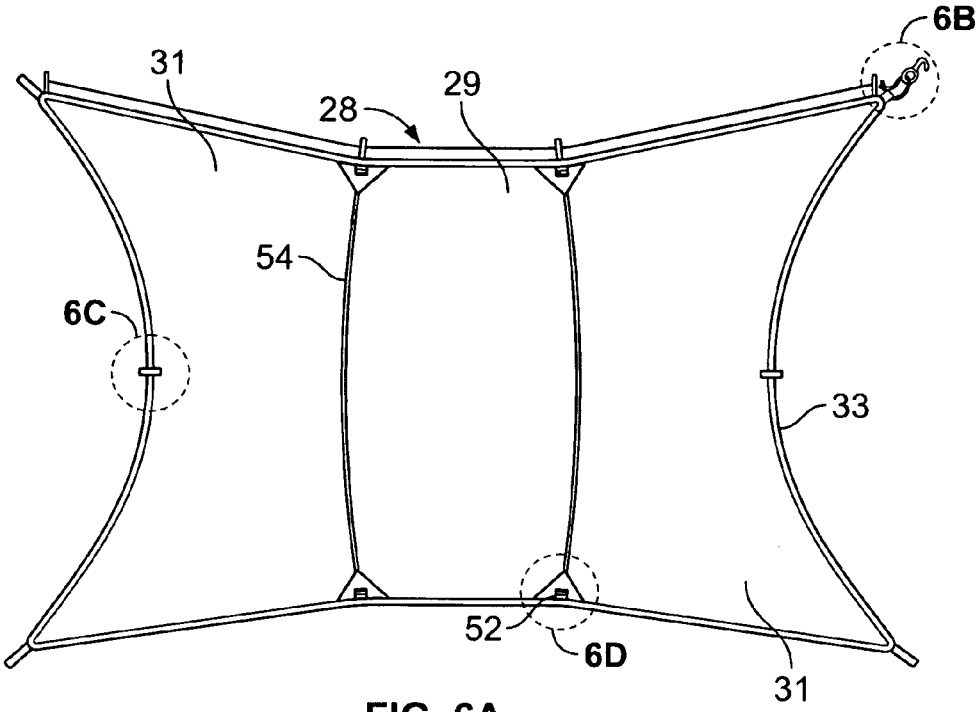
FIG. 6A shows a top plan view of the protective rainfly of the waterproof tent with various features shown in detail in FIGS. 6B–6D.
Figure 6B:
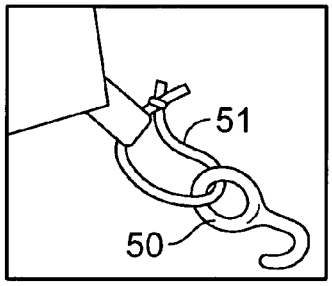
Figure 6C:
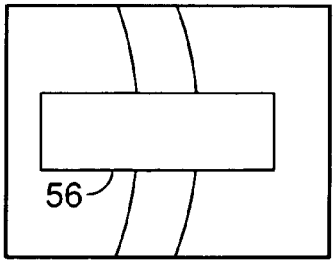
Figure 6D:
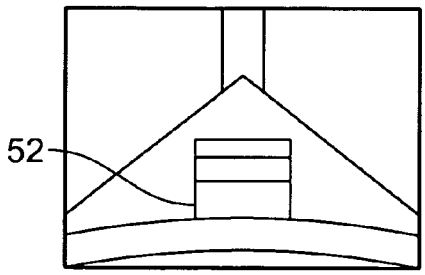

Various detail features are shown in FIGS. 4B–4E and 6B–D which correspond to the named detail circles in the main FIGS. 4A and 6A, respectively. FIG. 4B shows the skirt stake loop 35 attached by webbing to a corner of the skirt 34. FIGS. 4C(1) and 4C(2) show fasteners 45 used in various places. FIG. 4D shows a webbing loop 46 used for attachment to the ground by a stake. FIG. 4E shows an end loop 44 which has a loop 39 and a retaining pin 48 included to attach to the end of a piece of the framework 14.

Although the tent 10 is designed to be very waterproof, there may also be a desire for air circulation in the tent 10 (see FIGS. 4A–8). For this purpose, the ceiling 20 preferably has a screen portion 27. This is covered by a removable rainfly 28, which covers the screen portion 27 and extends past it in all directions so that rain is allowed to run off away from the openings and vents in the tent enclosure 16. FIG. 6B shows an elastic cord 51 and hook 50 used to maintain tension in the rain fly 28. The hooks 50 preferably attach to corners of the tent body 12. FIG. 6C shows attachments 56, such as VELCRO hook and loop fasteners (VELCRO is a registered trademark of VELCRO Industries B.V., Curacao, Netherlands), used in various places in the rainfly 28. FIG. 6D shows pole pockets 52 into which flexible support poles 54 for the rainfly 28 are optionally inserted.

The rainfly 28 preferably has a central panel 29 and two side panels 31. The central panel 29 covers the central portion of the ceiling screen 27, and the two side panels 31 have arched cutouts 33 along their outer perimeters which wrap around the extension sleeves 40 of the windows 24, helping to direct the rain away from openings and seams.

Figure 7:
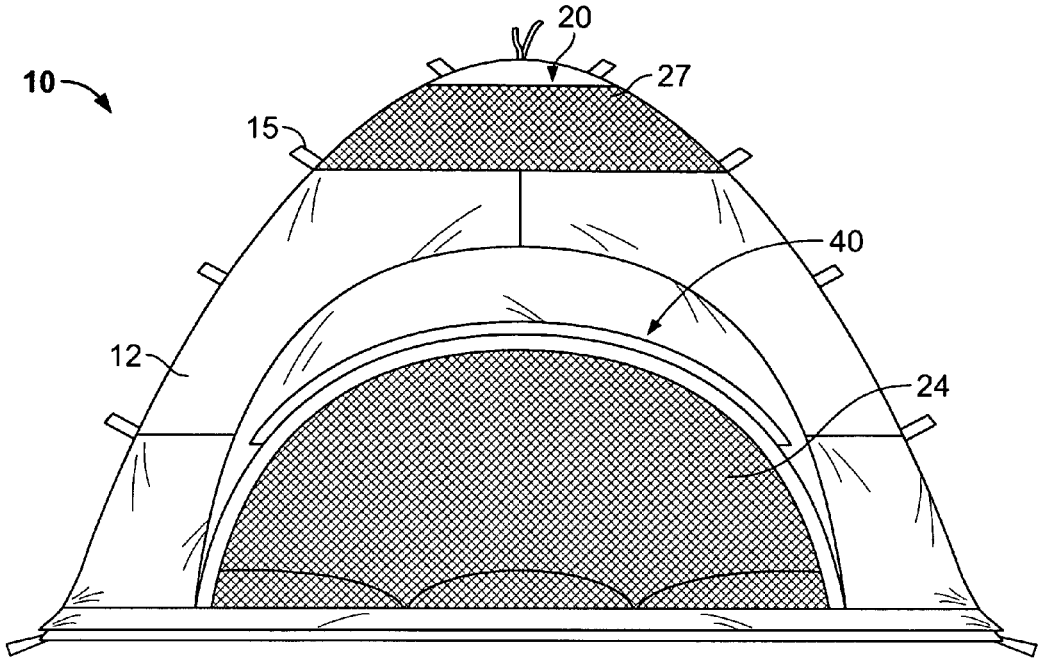
FIG. 7 shows a side view of the waterproof tent without its protective rainfly.

FIG. 7 shows a side view of the waterproof tent 10 without its protective rainfly 28.

Figure 8:
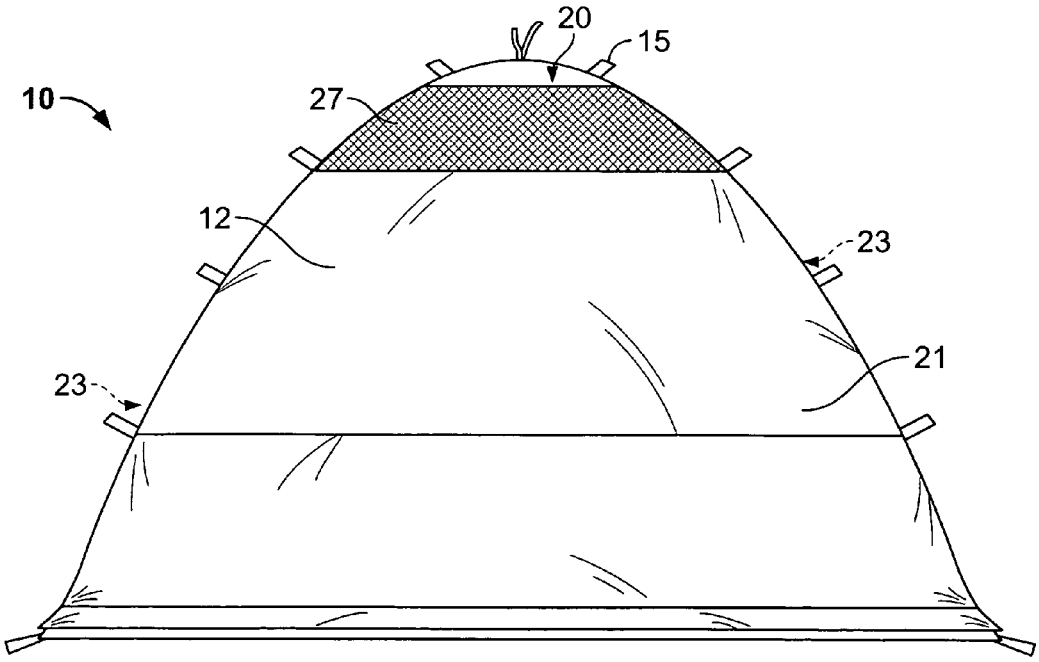
FIG. 8 shows a rear view of the waterproof tent without its protective rainfly.

FIG. 8 shows a rear view of the waterproof tent 10 without its protective rainfly 28.

While various embodiments have been described above, it should be understood that they have been presented by way of example only, and not limitation. Thus, the breadth and scope of a preferred embodiment should not be limited by any of the above described exemplary embodiments.

INDUSTRIAL APPLICABILITY

The present waterproof tent 10 is well suited for application in camping and recreational use or for emergency applications.

One of the most important aspects of comfort during camping involves remaining dry. Body heat is more easily lost through wet garments or sleeping gear, and there may be a very real danger of hypothermia in camping situations where clothing and sleeping bags have become wet, and no ready source of heat is available. Thus a dry environment for camping is of primary importance for enjoying the camping experience, and even in preserving life in some situations.

Several features of the present invention are included to preserve this dry environment. Primarily, there is used a hidden floor construction 30 in which a tub floor 32 is included inside an outer skirt 34. There are preferably separate loops 36 and stakes 38 used for the tub floor 32 and the skirt 34, although it is also possible that the tub floor stake loop 36 has a shock cord 37 which extends out under the corner of the tent and is then held down by the same stake 38 which is used to stake the skirt stake loop 35.

One major site of leakage is the upper seam where the stake loop 36 attaches to the floor or wall. To protect this area from rainfall, the present invention 10 includes a skirt 34, which is preferably attached to the tent walls 18 at or above the joining seam 25, thus rain fall is directed away from the floor 32, and particularly away from the attachment seam of the stake loop 36, and therefore helps to keep the interior dry.

The skirt 34 may be attached at the same joining seam 25 which attaches the tub floor 32 to the walls 18, or the skirt 34 may be attached at a point higher up vertically to protect the entire joining seam.

Additionally, the windows 24 of the side walls 23 are optionally equipped with extension sleeves 40 which protrude from the side walls 23 so that the windows 24 slope inward, and may extend at its highest point beyond the perimeter 4 of the floor 22. Guy wires 42 are included, which pull the windows 18 outward in their extension sleeves 40, and keep them taut. The windows 24 thus are sheltered from rain run-off.

For the above, and other, reasons, it is expected that the waterproof tent 10 of the present invention will have widespread industrial applicability. Therefore, it is expected that the commercial utility of the present invention will be extensive and long lasting.

What is claimed is:

1. A tent comprising:

a fabric enclosure including a plurality of walls and a floor defining a floor perimeter, each wall of said plurality of walls coupled to said floor at a joining seam positioned at a vertical distance with respect to a ground plane; and a skirt coupled to each wall at said joining seam and external to said floor perimeter, said skirt overlapping at least a portion of each wall.

2. A tent in accordance with claim 1 wherein said skirt further comprises a plurality of corners each secured to a ground area and said floor further comprises a plurality of corners each secured to the ground area.

3. A tent in accordance with claim 1 further comprising a frame supporting said fabric enclosure and urging said fabric enclosure outwardly.

4. A tent in accordance with claim 1 further comprising a rainfly covering at least a portion of said fabric enclosure.

5. A tent in accordance with claim 4 further comprising a ceiling defined by said fabric enclosure, said ceiling including a mesh portion providing ventilation to an interior of said tent and said rainfly covering said mesh portion.

6. A tent in accordance with claim 1 further comprising:

an extension sleeve coupled to a first wall of said plurality of walls; and a window positioned within said first wall, a first edge portion of said window coupled to said extension sleeve and a second edge portion of said window coupled to said first wall, said window sloping inwardly with respect to said floor perimeter from said first edge portion to said second edge portion.

7. A tent in accordance with claim 6 further comprising at least one guy wire urging said extension sleeve outwardly with respect to said floor perimeter.

8. A tent in accordance with claim 6 further comprising a rainfly having an arched cut-out portion corresponding to a perimeter of said extension sleeve.

9. A tent comprising:

a fabric enclosure including a plurality of walls and a floor defining a floor perimeter, each wall of said plurality of walls coupled to said floor at a joining seam positioned at a first vertical distance with respect to a ground plane; and a skirt coupled to each wall at a second vertical distance greater with respect to said ground plane than said first vertical distance and external to said floor perimeter, said skirt overlapping at least a portion of each wall.

10. A tent in accordance with claim 9 wherein said skirt further comprises a plurality of corners each secured with respect to a ground area and said floor further comprises a plurality of corners each secured with respect to the ground area.

11. A tent in accordance with claim 9 further comprising a frame supporting said fabric enclosure and urging said fabric enclosure outwardly.

12. A tent in accordance with claim 9 further comprising a rainfly covering at least a portion of said fabric enclosure.

13. A tent in accordance with claim 12 further comprising a ceiling defined by said fabric enclosure, said ceiling including a mesh portion providing ventilation to an interior of said tent and said rainfly covering said mesh portion.

14. A tent in accordance with claim 9 further comprising:

an extension sleeve coupled to a first wall of said plurality of walls; and a window positioned within said first wall, a first edge portion of said window coupled to said extension sleeve and a second edge portion of said window coupled to said first wall, said window sloping inwardly with respect to said floor perimeter from said first edge portion to said second edge portion.

15. A tent in accordance with claim 14 further comprising at least one guy wire urging said extension sleeve outwardly with respect to said floor perimeter.

16. A tent in accordance with claim 14 further comprising a rainfly having an arched cut-out portion corresponding to a perimeter of said extension sleeve.

17. A tent comprising:

a fabric enclosure forming a plurality of walls and a floor defining a floor perimeter, each wall of said plurality of walls coupled to said floor at a joining seam positioned at a vertical distance with respect to a ground plane; and a hidden floor construction comprising at least one skirt coupled to each wall at said joining seam and overlapping at least a portion of said joining seam.

18. A tent in accordance with claim 17 wherein said at least one skirt further comprises a plurality of corners each secured with respect to a ground area and said floor further comprises a plurality of corners each secured with respect to the ground area.

19. A tent comprising:

a fabric enclosure forming a plurality of walls and a floor defining a floor perimeter, each wall of said plurality of walls coupled to said floor at a joining seam positioned at a first vertical distance with respect to a ground plane; and a hidden floor construction comprising at least one skirt coupled to each wall at a second vertical distance greater with respect to said ground plane than said first vertical distance and overlapping at least a portion of said joining seam.

20. A tent in accordance with claim 19 wherein said at least one skirt further comprises a plurality of corners each secured with respect to a ground area and said floor further comprises a plurality of corners each secured with respect to the ground area.

* * * * *